US007422165B2

(12) United States Patent
Cernoia et al.

(10) Patent No.: US 7,422,165 B2
(45) Date of Patent: Sep. 9, 2008

(54) FUEL INJECTOR WITH ELECTROMAGNETIC ACTUATION OF THE PLUNGER

(75) Inventors: Fabio Cernoia, Zola Predosa (IT); Luca Cagnolati, Bologna (IT); Massimo Mattioli, Castelmaggiore (IT)

(73) Assignee: Magneti Marelli Powertrain S.p.A., Corbetta (IT)

( * ) Notice: Subject to any disclaimer, the term of this patent is extended or adjusted under 35 U.S.C. 154(b) by 317 days.

(21) Appl. No.: 11/253,787

(22) Filed: Oct. 20, 2005

(65) Prior Publication Data

US 2006/0086829 A1 Apr. 27, 2006

(30) Foreign Application Priority Data

Oct. 20, 2004 (IT) ..... BO2004A0649

(51) Int. Cl.
*B05B 1/30* (2006.01)
*F02M 61/20* (2006.01)

(52) U.S. Cl. ..... 239/585.1; 239/585.3; 239/585.5; 239/533.9

(58) Field of Classification Search ..... 239/585.1, 239/585.3, 585.4, 585.5, 533.2, 596, 552, 239/533.12, 88, 533.9; 251/129.15, 129.21, 251/127

See application file for complete search history.

(56) References Cited

U.S. PATENT DOCUMENTS 4,295,111 A * 10/1981 Frosch et al. ..... 335/256
5,100,102 A * 3/1992 Schechter ..... 239/585.4
5,769,391 A 6/1998 Noller et al.
5,881,957 A * 3/1999 Mizuno et al. ..... 239/533.2
6,318,646 B1 * 11/2001 Mattioli et al. ..... 239/585.1
6,373,363 B1 4/2002 Spakowski et al.
6,796,511 B2 * 9/2004 Hohl ..... 239/5
7,032,846 B1 * 4/2006 Heyse ..... 239/533.2
2003/0201346 A1 10/2003 Kato et al.

FOREIGN PATENT DOCUMENTS

EP 1 369 571 A 12/2003

OTHER PUBLICATIONS

European Search Report, issued in Application No. EP-05 10 9645, dated Aug. 24, 2006.

* cited by examiner

*Primary Examiner*—Davis D Hwu
(74) *Attorney, Agent, or Firm*—Venable LLP; Robert Kinberg; Steven J. Schwarz

(57) ABSTRACT

A fuel injector provided with an injection jet, an injection valve, the latter having a mobile plunger for regulating the flow of fuel through the injection jet, and an electromagnetic actuator, which is capable of displacing the plunger between a closed position and an open position of the injection valve and has a pair of electromagnets, each having a coil, a fixed magnetic armature, and a mobile armature; on the outer surface of a tubular supporting body of the injector, there are produced two annular slots, in each of which there is wound a corresponding coil of an electromagnet.

22 Claims, 4 Drawing Sheets

FUEL INJECTOR WITH ELECTROMAGNETIC ACTUATION OF THE PLUNGER

CROSS-REFERENCE TO RELATED APPLICATION

This application claims the priority of Italian Patent Application No. BO2004A 000649 filed Oct. 20, 2004, the subject matter of which is incorporated herein by reference.

BACKGROUND OF THE INVENTION

The present invention relates to a fuel injector with electromagnetic actuation of the plunger.

An electromagnetic fuel injector normally comprises a tubular supporting body with a central channel which performs the function of a fuel duct and ends in an injection jet regulated by an injection valve controlled by an electromagnetic actuator. The injection valve is provided with a plunger, which is rigidly connected to a mobile armature of the electromagnetic actuator so as to be displaced by the action of the electromagnetic actuator between a closed position and an open position of the injection jet against the action of a spring, which tends to hold the plunger in the closed position.

One example of an electromagnetic fuel injector of the above-described type is given in U.S. Pat. No. 6,027,050-A1, which relates to a fuel injector provided with a plunger that, at one end, co-operates with a valve seat and at the opposite end is integral with a mobile armature of an electromagnetic actuator; the plunger is guided at the top by the armature and is guided at the bottom by sliding of the end portion of the plunger in a guide portion of the valve seat.

Known electromagnetic fuel injectors of the above-described type are very widely used because they combine good performance with low cost. However, such injectors with electromagnetic actuation of the plunger are not capable of operating at very high fuel pressures; it is for this reason that injectors with hydraulic actuation of the plunger have been proposed, i.e. injectors in which displacement of the plunger from the closed position to the open position against the action of the spring proceeds under the effect of hydraulically generated forces. One example of an injector with hydraulic actuation of the plunger is provided by patent applications EP-1036932-A2 and EP-0921302-A2; a further example of an injector with hydraulic actuation of the plunger is provided by patent application WO-0129395-A1.

Injectors with hydraulic actuation of the plunger exhibit good dynamic performance and are capable of operating at very high fuel pressures. However, such injectors are complex and costly to produce because they require the provision of a hydraulic circuit having a piezoelectrically or electromagnetically actuated control valve. Moreover, in an injector with hydraulic actuation of the plunger, there is always a certain degree of backflow of fuel, which is discharged at ambient pressure; such fuel backflow has two negative effects in that it wastes energy and tends to heat up the fuel. Finally, in an injector with hydraulic actuation of the plunger, there is a substantial drop in fuel pressure due to the load losses brought about by the injector itself; by way of example, if the fuel is supplied to an injector with hydraulic actuation of the plunger at an inlet pressure of 120 MPa, there may be load losses of up to 20 MPa brought about by the injector, such that the effective injection pressure of the fuel is 100 MPa.

US2003201346 discloses A fuel injection valve, which has an electromagnetic coil using an insulated coil wire covered with an insulating coating and having a fusion bonding layer with self-fusing properties coated over the insulating coating; therefore, it is possible to dispense with the use of a bobbin and hence possible to provide a low-cost and compact fuel injection valve that requires a reduced number of man-hours for production. Further, a flaw or a pinhole in the insulating coating is repaired by self-fusion, and thus insulation properties and waterproofness are improved; accordingly, it is possible to prevent disconnection of the coil due to electrolytic corrosion.

SUMMARY OF THE INVENTION

The aim of the present invention is to produce a fuel injector with electromagnetic actuation of the plunger, which injector does not exhibit the above-described disadvantages and, in particular, is straightforward and economic to produce.

According to the present invention, a fuel injector is produced with electromagnetic actuation of the plunger as recited in the attached claims.

BRIEF DESCRIPTION OF THE DRAWINGS

The present invention will now be described with reference to the attached drawings, which illustrate some non-limiting embodiments of the invention, wherein.

DETAILED DESCRIPTION OF THE INVENTION

Figure 1:
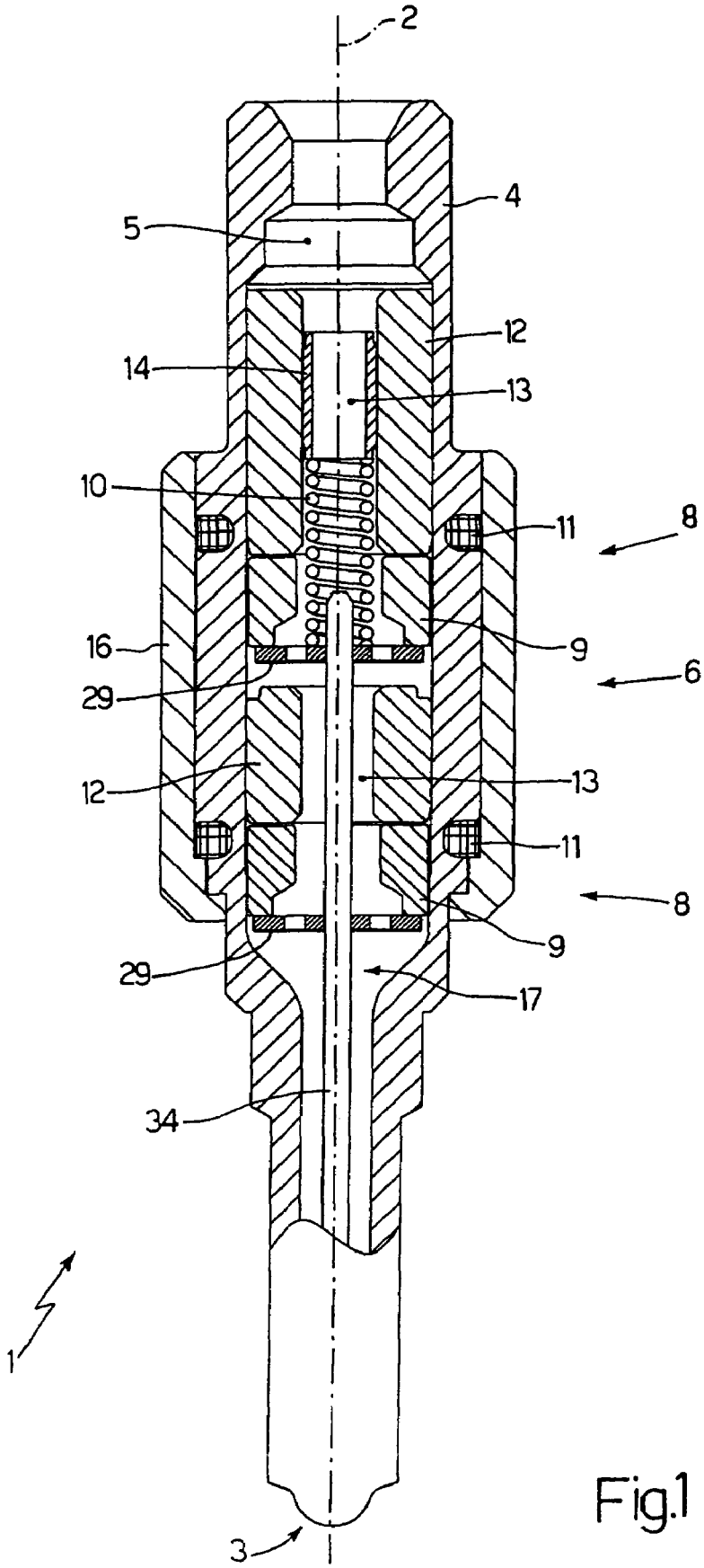
FIG. 1 is a diagrammatic, partially sectional, side view of a fuel injector produced according to the present invention.

In FIG. 1, 1 denotes the overall fuel injector, which has a substantially cylindrical symmetry around a longitudinal axis 2 and is capable of being controlled so as to inject fuel from an injection jet 3 that opens directly into an explosion chamber (not shown) of a cylinder. The injector 1 comprises a supporting body 4, which has a tubular cylindrical shape of variable cross-section along the longitudinal axis 2 and has a supply channel 5 extending along the entire length of said supporting body 4 so as to supply pressurised fuel to the injection jet 3. The supporting body 4 accommodates an electromagnetic actuator 6 at the level of an upper portion thereof and an injection valve 7 (shown in FIG. 2) at the level of a lower portion thereof; in service, the injection valve 7 is actuated by the electromagnetic actuator 6 so as to regulate the flow of fuel through the injection jet 3, which is produced at the level of said injection valve 7.

Figure 3:
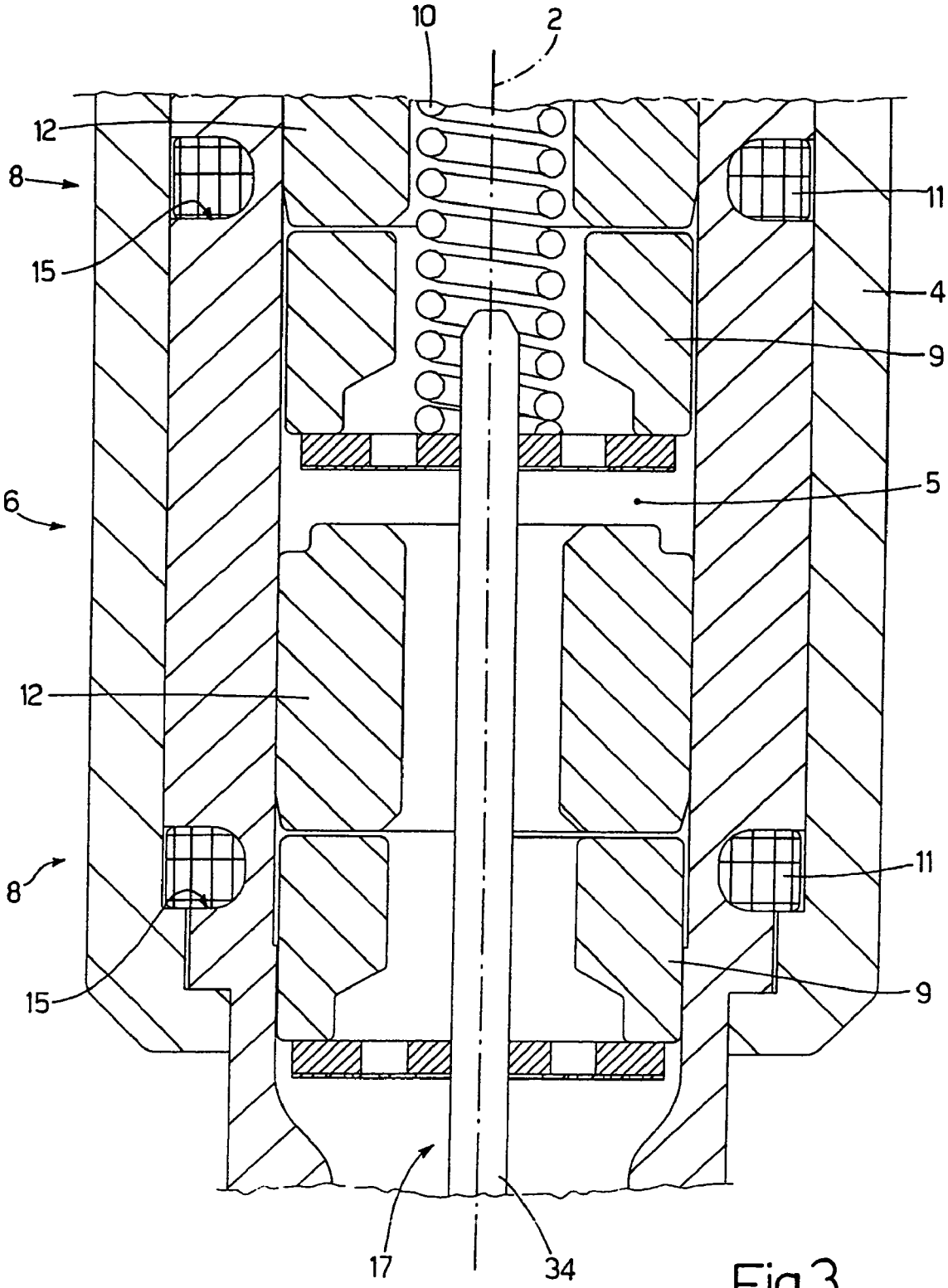
FIG. 3 shows an enlarged view of a pair of electromagnetic actuators of the injector in FIG. 1.

As shown in FIG. 3, the electromagnetic actuator 6 comprises a pair of electromagnets 8 (upper and lower respectively), each of which, when energised, is capable of displacing along the axis 2 a mobile armature 9 of ferromagnetic material from a closed position to an open position of the injection valve 7 against the action of a spring 10 that tends to hold the mobile armature 9 in the closed position of the injection valve 7. In particular, each electromagnet 8 comprises a coil 11, which is supplied with electricity by an electronic control unit (not shown) and is accommodated outside the supporting body 4, and a magnetic armature 12, which is accommodated inside the supporting body 4 and has a central hole 13 to allow the fuel to flow towards the injection jet 3. Inside the central hole 13 of the magnetic armature 12 of the upper electromagnetic 8, an abutment member 14 is driven into a fixed position, which abutment member is of a tubular cylindrical shape (optionally open along a generating line) to allow the fuel to flow towards the injection jet 3 and is capable of holding the spring 10 in a compressed state against the mobile armature 9 of the upper electromagnet 8. Each electromagnet 8 is magnetically independent from the other electromagnet 8 and thus comprises a coil 11 separate from the coil 11 of the other electromagnet 8, a fixed magnetic armature 12 separate from the fixed magnetic armature 12 of the other electromagnet 8, and a mobile armature 9 separate from the mobile armature 9 of the other electromagnet 8.

Each coil 11 is wound directly within a respective annular slot 15, which is produced by removal of material from the outer surface of the supporting body 4 and has an arc-shaped cross-section to ensure maximum structural strength. Each coil 11 is constituted by a conductive wire, which is enamelled and provided with a self-bonding varnish, and has a particularly small axial dimension (i.e. measured along the longitudinal axis 2) in order to keep dispersed magnetic flux to a minimum; in particular, each coil 11, and thus each slot 15, has a substantially square cross-section, i.e. having an approximately identical height and depth. At the level of the coils 11, a protective body 16, tubular in shape, is fixed around the supporting body 4, which protective body serves to provide sufficient mechanical protection to the coils 11, to allow closure of the magnetic flux lines generated by the coils 11, and to increase the mechanical strength of the supporting body 4 at the level of the structural weaknesses inevitably caused by the presence of the slots 15.

The mobile armatures 9 are part of a mobile assembly, which also comprises a poppet or plunger 17 having an upper portion integral with each mobile armature 9 and a lower portion that co-operates with a valve seat 18 (shown in FIG. 2) of the injection valve 7 in order to regulate the flow of fuel through the injection jet 3 in known manner.

In service, when the electromagnets 8 are de-energised, each mobile armature 9 is not attracted by its magnetic armature 12 and the resilient force of the spring 10 thrusts the mobile armatures 9 together with the plunger 17 downwards; in this situation, the injection valve 7 is closed. When the electromagnets 8 are energised, each mobile armature 9 is magnetically attracted by its magnetic armature 12 against the resilient force of the spring 10 and the mobile armatures 9 together with the plunger 17 are moved upwards in order to bring about opening of the injection valve 7.

In order to define precisely the upward stroke performed by the plunger 17, the mobile armature 9 of the upper electromagnet 8 has an effective stroke that is shorter than the effective stroke of the mobile armature 9 of the lower electromagnet 8. In this manner, when the electromagnets 8 are energised, it is always only the mobile armature 9 of the upper electromagnet 8 that strikes its magnetic armature 12 irrespective of any inevitable structural tolerances. In order to limit the effective stroke of the mobile armature 9 of the upper electromagnet 8, the lower surface of the armature 12 or the upper surface of the mobile armature 9 is covered with a layer of a hard and non-ferromagnetic metallic material, preferably chromium; in this manner, the thickness of the layer of chromium determines the reduction in the effective stroke of the mobile armature 9 of the upper electromagnet 8. Further functions of the chromium layer are to increase the impact resistance of the zone and, especially, to avoid magnetic adhesion phenomena due to direct contact between the ferromagnetic material of the mobile armature 9 and the ferromagnetic material of the armature 12. In other words, the chromium layer defines a magnetic gap, which prevents the magnetic attraction forces due to the residual magnetism between the mobile armature 9 and the armature 12 from becoming too high, i.e. exceeding the resilient force generated by the spring 10.

Figure 2:
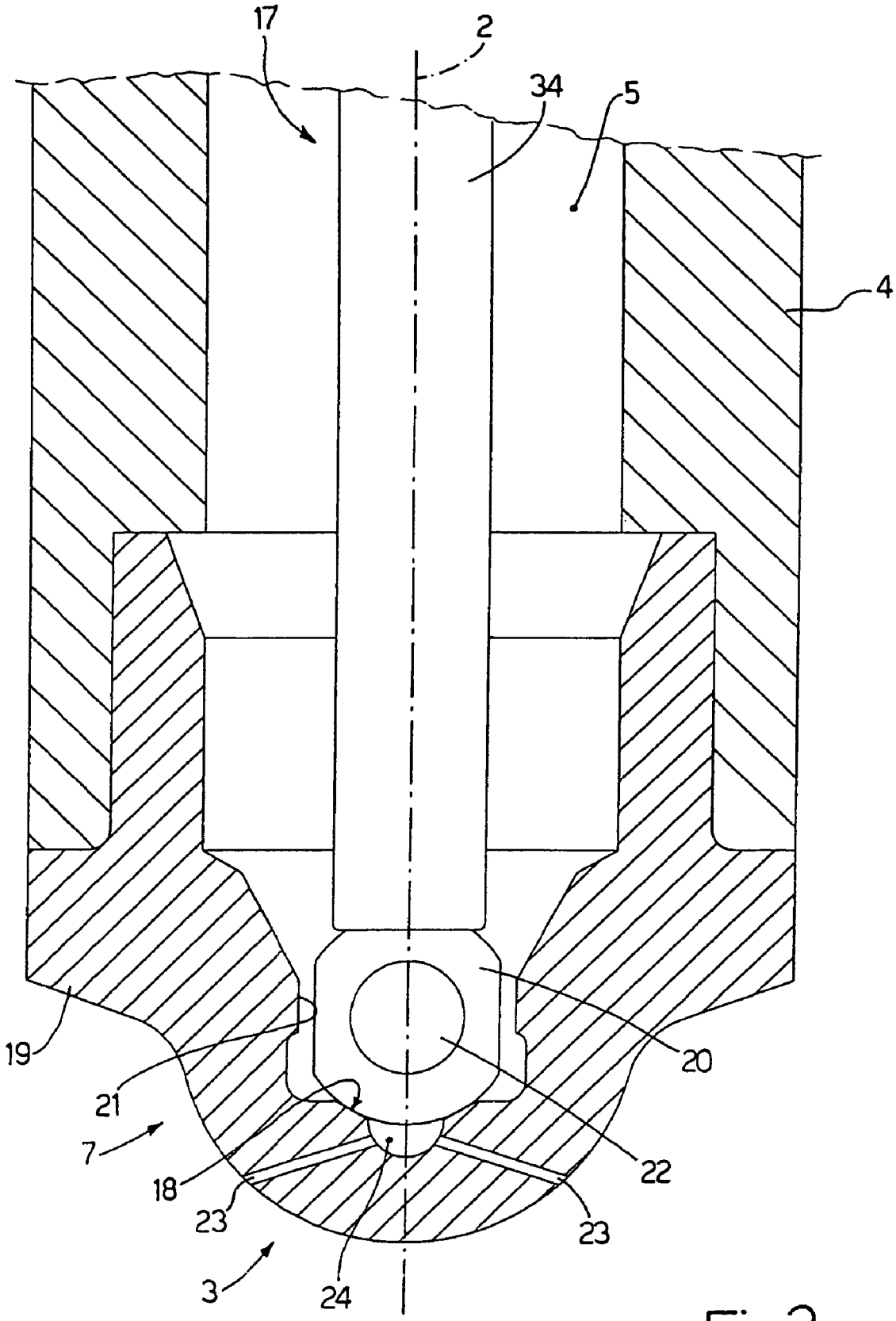
FIG. 2 shows an enlarged view of an injection valve of the injector in FIG. 1.

As shown in FIG. 2, the valve seat 18 is defined by a sealing member 19, which seals the bottom of the supply channel 5 of the supporting body 4, and is passed through by the injection jet 3. In particular, the sealing member 19 is screwed inside the supporting body 4 in order to ensure the mechanical tightness of the joint and is subsequently welded to said supporting body 4 in order to ensure the hydraulic tightness of the joint.

The plunger 17 ends in a plugging head 20, substantially spherical in shape, which is capable of resting in sealing manner against the valve seat 18. At the level of the plugging head 20, the sealing member 19 has an annular guide member 21, on which the plugging head 20 rests so that it can slide; the function of the guide member 21 is to define a lower guide for the movement of the plunger 17 along the longitudinal axis 2. The plugging head 20 has four flattened portions 22 (only three of which are visible in FIG. 2) at the level of the guide member 21 so as to create four passages for the fuel towards the injection jet 3. The injection jet 3 is defined by a plurality of injection through-holes 23 (only two of which are shown in FIG. 2), which are produced starting from a hemispherical injection chamber 24 arranged immediately downstream from the valve seat 18.

Figure 4:
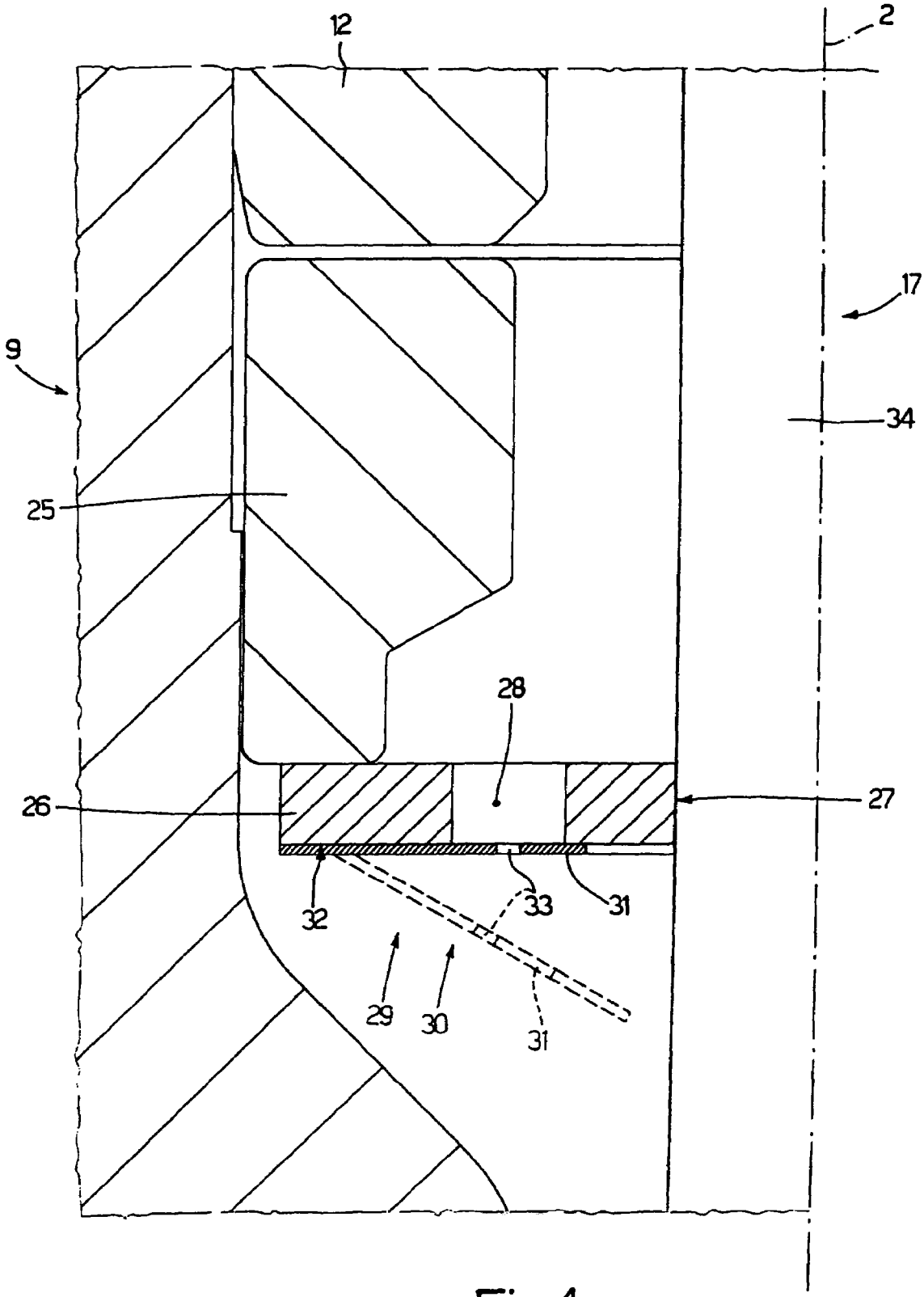
FIG. 4 shows an enlarged view of a detail of an armature of one of the electromagnetic actuators in FIG. 3.

As shown in FIG. 4, each mobile armature 9 comprises an annular member 25 and a discoid member 26, which closes off the bottom of the annular member 25 and has a central through-hole 27 capable of receiving an upper portion of the plunger 17 and a plurality of peripheral supply through-holes 28 (only two of which are shown in FIG. 4) capable of allowing the fuel to flow towards the injection jet 3. The plunger 17 is preferably made integral with the discoid member 26 of each mobile armature 9 by means of an annular weld. A central portion of the discoid member 26 of the mobile armature 9 of the upper electromagnet 8 abuts against a lower end of the spring 10.

The annular member 25 of each mobile armature 9 has an external diameter substantially identical to the internal diameter of the corresponding portion of the supply channel 5 of the supporting body 4; in this manner, each mobile armature 9 can slide relative to the supporting body 4 along the longitudinal axis 2, but cannot make any movement transverse to the longitudinal axis 2, relative to the supporting body 4. Since the plunger 17 is rigidly connected to each mobile armature 9, it is clear that each mobile armature 9 also acts as an upper guide for the plunger 17; as a result, the plunger 17 is guided at the top by the mobile armatures 9 and at the bottom by the guide member 21.

An antirebound device 29 of the hydraulic type is attached to the lower face of the discoid member 26 of each mobile armature 9, which antirebound device is capable of damping the rebound of the plugging head 20 of the plunger 17 against the valve seat 18 when the plunger 17 moves from the open position to the closed position of the injection valve 7. Each antirebound device 29 comprises respective valve members 30, each of which is coupled with a respective peripheral supply hole 28 of the mobile armature 9 and has a different permeability to the passage of the fuel depending upon the direction of passage of said fuel through the supply hole 28. In particular, each valve element 30 comprises a resilient sheet 31, which is in part fixed to a lower surface 32 of the mobile armature 9 on only one side of the respective supply hole 28 and comprises a hole 33 of smaller dimensions aligned with said supply hole 28; when the fuel flows downwards, i.e.

towards the injection jet 3, the sheet 31 deforms under the thrust of the fuel, allowing the fuel to flow substantially freely through the supply hole 28, while, when the fuel flows upwards, the sheet 31 is pressed against the lower surface 32 of the mobile armature 9 by the thrust of the fuel, closing the supply hole 28 and allowing the fuel to flow only through its smaller dimension hole 33. In other words, each antirebound device 29 constitutes an asymmetric system for damping the kinetic energy of the corresponding mobile armature 9.

The plunger 17 has a rod 34 with cylindrical symmetry, to which is connected the substantially spherical plugging head 20 by means of an annular weld. When the mobile armature 9 of the upper electromagnet comes to a standstill against its magnetic armature 12, direct longitudinal stresses parallel to the longitudinal axis 2 are obviously generated on the mobile armature 9. Because of the inevitable structural tolerances of the various components, the upper surface of the mobile armature 9 may not be perfectly plane and perfectly parallel to the lower surface of the magnetic armature 12 and the plunger 17 may not be perfectly perpendicular relative to the mobile armature 9; consequently, when the mobile armature 9 comes to a standstill against the magnetic armature 12, direct transverse stresses perpendicular to the longitudinal axis 2 may be generated on the mobile armature 9. A proportion of such transverse stresses is also transmitted to the plunger 17 and is dissipated at the level of the coupling between the plugging head 20 of the plunger 17 and the guide member 21.

It is necessary to limit the intensity of the stresses that are dissipated at the level of the coupling between the plugging head 20 of the plunger 17 and the guide member 21, so as to avoid excessive localised wear phenomena of the plugging head 20. The approach to limiting the intensity of such negative stresses has always been to limit the transverse stresses generated at the level of the mobile armature 9 by means of precision machining of the components in order to obtain very tight structural tolerances. However, it has been observed that it is also possible to use a different approach in order to limit the intensity of such negative stresses, namely instead of limiting the transverse stresses generated at the level of the mobile armature 9, it is possible to limit the transmission of the transverse stresses from the mobile armature 9 to the plugging head 20 of the plunger 17. To this end, it is possible to make the rod 34 of the plunger 17 in such a manner as to impart to said rod 34 relatively high flexibility (or in other words relatively low flexural rigidity), which flexibility is certainly greater than that normally present in known, currently commercially available injectors; it has in fact been observed that increasing the flexibility of the rod 34 reduces the transmission of transverse stresses from the mobile armature 9 to the plugging head 20. In other words, if the rod 34 of the plunger 17 is sufficiently flexible, the transmission of transverse stresses from the mobile armature 9 to the plugging head 20 is reduced and it is then no longer necessary to precision-machine the components with the aim of achieving very tight structural tolerances.

It is important to note that the rod 34 of the plunger 17 must not be too flexible, because if it were too flexible it would not be capable of ensuring rapid and precise control of the injection valve 7.

Theoretical analyses and experimental testing have led to the definition of a flexibility parameter $P_f$, which is a reliable indicator of the flexibility of the rod 34 and has the dimensions of a pressure ($N/mm^2$). It is important to note that, since the flexibility parameter $P_f$ has the dimensions of a pressure ($N/mm^2$), said flexibility parameter Pf can be traced back to the phenomenon of contact/impact pressure wear between the plugging head 20 and the guide member 21.

The flexibility parameter $P_f$ is calculated using the following equation:

$$P_f = K_{eq}/D_h$$

in which:

$P_f$ [$N/mm^2$] is the flexibility parameter;

$D_h$ [mm] is the diameter of the plugging head 20 of the plunger 17;

$K_{eq}$ [N/mm] is the equivalent rigidity of the rod 34 of the plunger 17.

The equivalent rigidity $K_{eq}$ of the rod 34 of the plunger 17 is defined by assuming that the rod 34 is restrained at one end and subjected to a force F at the opposite end so as to inflect the rod 34 by a deflection f at its free end; in the above-stated situation, the equivalent rigidity $K_{eq}$ of the rod 34 is calculated using the following equation:

$$K_{eq} = F/f$$

in which:

$K_{eq}$ [N/mm] is the equivalent rigidity of the rod 34 of the plunger 17;

F [N] is the force applied to the free end of the rod 34;

f [mm] is the deflection of the free end of the rod 34.

In the case of a rod 34 of a constant circular cross-section made from a single material, the equivalent rigidity $K_{eq}$ can be calculated using the following equation:

$$K_{eq} = (E*D_s^4)/(6.8*L_s^3)$$

where:

$K_{eq}$ [N/mm] is the equivalent rigidity of the rod 34 of the plunger 17;

$D_s$ [mm] is the diameter of the circular cross-section of the rod 23;

$L_s$ [mm] is the length of the rod 23;

E [$N/mm^2$] is the modulus of elasticity of the constituent material of the rod.

In the case of a rod 34 made from a single material and composed of two or more cylindrical sections of different diameters, the equivalent rigidity $K_{eq}$ can be calculated using the following equation:

$$1/K_{eq} = \Sigma_i 1/K_i$$

where:

$K_{eq}$ [N/mm] is the equivalent rigidity of the rod 34 of the plunger 17;

$K_i$ [N/mm] is the equivalent rigidity of the i-th cross-section of the rod 34 calculated using the above-stated formula.

In order to achieve the desired effect of limiting the transmission of the transverse stresses from the mobile armature 9 to the plugging head 20 without however prejudicing the performance of the injection valve 7, the flexibility parameter $P_f$ must be between 0.3 and 4 $N/mm_2$. The flexibility parameter $P_f$ is preferably between 0.4 and 0.8 $N/mm^2$ and is substantially equal to approx 0.6 $N/mm^2$.

By way of example, in order to obtain a desired value of the flexibility parameter $P_f$, it is possible to use several approaches which are alternatives and/or can be combined with one another in different ways: the cross-section of the rod 34 can be varied, a material of greater or lesser elasticity can be used to produce the rod 34, the cross-sectional shape of the rod 34 can be varied.

The above-described injector 1 is simple and economic to manufacture because it is produced in its entirety by combining components which are of cylindrical symmetry and can thus readily be obtained by turning and drilling operations. Moreover, the above-described injector 1 makes it possible to operate with very high fuel pressures (by way of information, up to 160 MPa) without exhibiting significant load losses.

The invention has been described in detail with respect to preferred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. A fuel injector comprising:

an injection jet;

an injection valve including a mobile plunger for regulating the flow of fuel through the injection jet;

an electromagnetic actuator adapted to displace the plunger between a closed position and an open position of the injection valve, the electromagnetic actuator including a first electromagnet and a second electromagnet that are magnetically independent from one another, wherein each electromagnet comprises:

a coil, wherein the coil of the first electromagnet is separate from the coil of the second electromagnet;

a fixed magnetic armature, wherein the fixed magnetic armature of the first electromagnet is separate from the fixed magnetic armature of the second electromagnet; and a mobile armature mechanically fixed to the plunger, wherein the mobile armature of the first electromagnet is separate from the mobile armature of the second electromagnet;

a spring adapted to hold the plunger in the closed position; and a supporting body having a tubular shape including a central channel, which accommodates the fixed magnetic armatures and the mobile armatures; the supporting body further including a pair of annular slots, which are spaced apart from one another and are located on the outer surface of said supporting body; wherein the coil of each electromagnet is wound directly within the respective annular slot;

wherein the first and second electromagnets are adapted to move their respective mobile armatures in the same direction upon energization of the first and second electromagnets, whereby the mobile armatures of the first and second electromagnets both move the plunger to open the injection valve.

2. Injector according to claim 1, wherein each slot has an arc-shaped cross-section.

3. Injector according to claim 1, wherein the coil comprises a conductive wire that is enamelled and includes a self-bonding varnish.

4. Injector according to claim 1, wherein the coil, and the slot have a substantially square cross-section.

5. Injector according to claim 1, further comprising a protective body, which is tubular in shape and is arranged around the supporting body and covers the coils.

6. Injector according to claim 1, wherein the mobile armature of the first electromagnet has an effective stroke that is shorter than the effective stroke of the mobile armature of the second electromagnet.

7. Injector according to claim 6, wherein, in order to limit the effective stroke of the mobile armature of the first electromagnet, the lower surface of the armature or the upper surface of the mobile armature is covered with a layer of a hard and non-ferromagnetic metallic material.

8. Injector according to claim 7, wherein, in order to limit the effective stroke of the mobile armature of the first electromagnet, the lower surface of the armature or the upper surface of the mobile armature is covered with a layer of chromium.

9. Injector according to claim 1, wherein the plunger includes a plugging head, substantially spherical in shape, which is adapted to rest in sealing manner against the valve seat.

10. Injector according to claim 9, wherein the valve seat is defined by a sealing member including an annular guide member; and the plugging head has a number of flattened portions adapted to create a number of passages for the fuel towards the injection jet.

11. Injector according to claim 9, wherein the injection jet is defined by a plurality of injection through-holes, which extend from an injection chamber arranged immediately downstream from the injection seat.

12. Injector according to claim 1, wherein the mobile armature comprises an annular member and a discoid member, wherein the discoid member is adapted to close the bottom of the annular member and, includes a central through-hole adapted to receive a portion of the plunger, and a plurality of peripheral supply through-holes adapted to allow the fuel to flow towards the injection jet.

13. Injector according to claim 1, wherein the mobile armature has at least one supply through-hole for the passage of the fuel towards the injection jet and is provided with an antirebound device of the hydraulic type coupled with the supply hole.

14. Injector according to claim 13, wherein the antirebound device of the hydraulic type comprises a valve element coupled with the supply hole of the mobile armature, wherein the valve element has a different permeability to the passage of fuel depending upon the direction of passage of the fuel through the supply hole.

15. Injector according to claim 14, wherein the valve member comprises a resilient sheet fixed to a lower surface of the mobile armatures, the resilient sheet including a hole aligned with the supply hole and having a smaller dimension than said supply hole.

16. Injector according to claim 1, wherein the plunger comprises an elongate rod mechanically connected to the mobile armature, and a plugging head adapted to engage in a sealing manner with a valve seat of the injection valve; wherein the rod of the plunger has a flexibility parameter (Pf) of between 0.3 and 4 N/mm$^2$.

17. Injector according to claim 16, wherein the flexibility parameter (Pf) is between 0.3 and 0.9 N/mm$^2$.

18. Injector according to claim 16, wherein the flexibility parameter (Pf) is between 0.5 and 0.7 N/mm$^2$.

19. Injector according to claim 16, wherein the flexibility parameter (Pf) is around 0.6 N/mm$^2$.

20. Injector according to claim 16, wherein the plugging head is substantially spherical in shape.

21. Injector according to claim 20, wherein the flexibility parameter ($P_f$) is calculated using the following equation:

$$P_f = K_{eq}/D_h$$

in which:

$P_f$ [N/mm$^2$] is the flexibility parameter;

$D_h$ [mm] is the diameter of the plugging head;

$K_{eq}$ [N/mm] is the equivalent rigidity of the rod.

22. Injector according to claim 21, wherein the equivalent rigidity ($K_{eq}$) of the rod is defined by assuming that the rod is fixed at one end and subjected to a force (F) at the opposite end so as to inflect the rod by a deflection (f) at its free end; in the above-stated situation, the equivalent rigidity ($K_{eq}$) of the rod is calculated using the following equation:

$$K_{eq}=F/f$$

in which:

$K_{eq}$ [N/mm] is the equivalent rigidity of the rod;

F [N] is the force applied to the free end of the rod;

f [mm] is the deflection of the free end of the rod.

* * * * *